US006695753B2

(12) United States Patent
Ho et al.

(10) Patent No.: US 6,695,753 B2
(45) **Date of Patent: *Feb. 24, 2004**

(54) HANDLE-ASSISTED EXERCISER

(75) Inventors: Sung-Chao Ho, Taipei (TW); Michael E. Casey, Santa Monica, CA (US)

(73) Assignee: Michael Casey, Santa Monica, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/809,851

(22) Filed: Mar. 15, 2001

(65) Prior Publication Data

US 2002/0022558 A1 Feb. 21, 2002

Related U.S. Application Data

(63) Continuation of application No. 09/396,510, filed on Sep. 15, 1999, now Pat. No. 6,206,808.

(51) Int. Cl.[7] ..... A63B 21/068

(52) U.S. Cl. ..... 482/95; 482/140; 482/148; 482/142

(58) Field of Search ..... 482/140, 148, 482/71–72, 95–96, 135, 142, 908

(56) References Cited

U.S. PATENT DOCUMENTS 4,489,936 A * 12/1984 Dal Monte ..... 272/120
5,997,450 A * 12/1999 Wilkinson ..... 482/142
6,206,808 B1 * 3/2001 Ho ..... 482/95

* cited by examiner

*Primary Examiner*—Nicholas D. Lucchesi
*Assistant Examiner*—L Amerson
(74) *Attorney, Agent, or Firm*—Cislo & Thomas LLP

(57) ABSTRACT

An angle-adjustable rowing exerciser, which includes a wheeled base frame, a fixed mattress and a pivoted mattress supported on the base frame, a transverse frame bar pivotally mounted on the base frame at the bottom, two handlebars respectively adjustably connected to two adjustable ratchet connectors at the ends of the transverse frame bar for turning by hand to rotate the transverse frame bar, and two actuating bars perpendicularly and fixedly connected to the transverse frame bar and forced to tilt the base frame or the movable mattress up and down upon turning of the handlebars.

18 Claims, 6 Drawing Sheets

HANDLE-ASSISTED EXERCISER

CROSS-REFERENCE TO RELATED APPLICATIONS

This patent application is a continuation of U.S. patent application Ser. No. 09/396,510 filed Sep. 15, 1999, now U.S. Pat. No. 6,206,808.

BACKGROUND OF THE INVENTION

Field of the Invention

The present invention relates to a rowing exerciser, and more particularly to an angle-adjustable rowing exerciser, which can be conveniently adjusted to the desired angle of inclination.

A variety of exercising apparatus have been disclosed for different exercising purposes, and have appeared on the market. Regular multipurpose exercising apparatus are commonly heavy and expensive, and not suitable for home use. Regular simple climbers, rowers, stationary bicycles are less expensive, and suitable for home use. However, these exercising apparatus are designed for one particular exercising purpose only.

SUMMARY OF THE INVENTION

The present invention has been accomplished under the circumstances in view. It is one object of the present invention to provide an angle-adjustable rowing exerciser, which is practical for exercising different parts of the body. It is another object of the present invention to provide an angle-adjustable rowing exerciser, which is inexpensive to manufacture, and suitable for home use. It is still another object of the present invention to provide an angle-adjustable rowing exercising, which can be conveniently adjusted to fit different exercising requirements. According to one aspect of the present invention, the angle-adjustable rowing exerciser comprises a wheeled base frame, a fixed mattress and a pivoted mattress supported on the base frame, a transverse frame bar pivotally mounted on the base frame at the bottom, two handlebars respectively connected to the ends of the transverse frame bar for turning by hand to rotate the transverse frame bar, and two actuating bars perpendicularly and fixedly connected to the transverse frame bar and forced to tilt the base frame or the movable mattress up and down upon turning of the handlebars. According to another aspect of the present invention, the transverse frame bar comprises two adjustable ratchet connectors at its two distal ends respectively connected to the handlebars, enabling the handlebars to be adjusted to one of a series of angular positions relative to the transverse frame bar.

DESCRIPTION OF THE PREFERRED EMBODIMENT(S)

Figure 2:
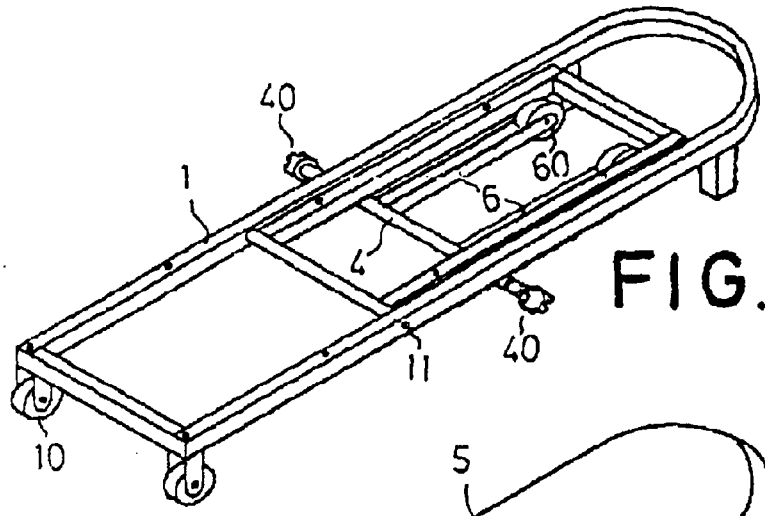
FIG. 2 is a perspective view of the present invention after removal of the first mattress, the second mattress, and the handlebars.
Figure 1:
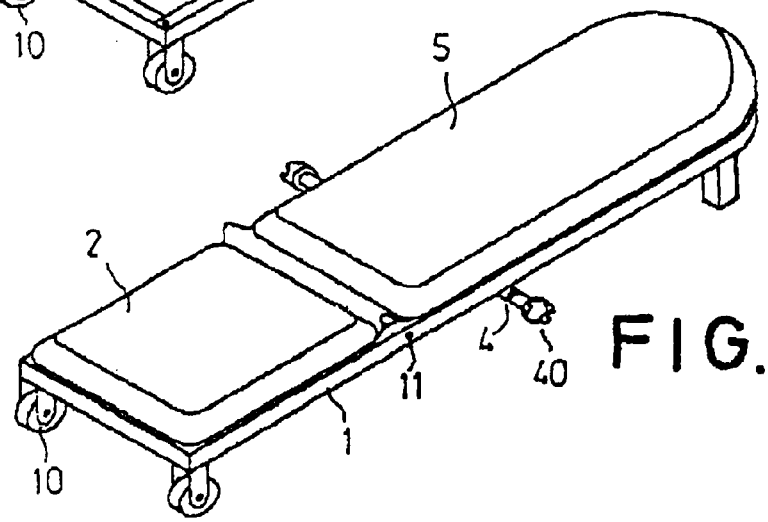
FIG. 1 is a perspective view of an angle-adjustable rowing exerciser according to the present invention (the handlebars excluded)

Referring to FIGS. from 1 through 4, an angle-adjustable rowing machine is sown comprised of an elongated base frame 1, a first mattress 2, a pair of handlebars 3, a transverse frame bar 4, a second mattress 5, and a pair of actuating bars 6.

The base frame 1 is equipped with rollers 10 for easy moving on the floor. The first mattress 2 is fixedly mounted on the base frame 1 at one end. The second mattress 5 has one end pivoted to a middle part of the base frame 1 by a pivot 11. When lied down, the second mattress 5 is supported on the base frame 1 and aligned with the first mattress 2 in a line. The transverse frame bar 4 is pivotally mounted on the base frame 1 below the second mattress 5, having two ratchet connectors 40 at two distal ends thereof. The handlebars 3 are respectively connected to the ratchet connectors 40, and adjusted to the desired angle relative to the transverse frame bar 4. The actuating bars 6 are perpendicularly and fixedly connected to the transverse frame bar 4, each having a distal end mounted with a roller 60. The base frame 1 may set holes 12 at the side of the second mattress 5 (see FIGS. 11 and 12). The holes 12 can insert a bar to confine the inclined angle of the actuating bars 6.

Figure 4:
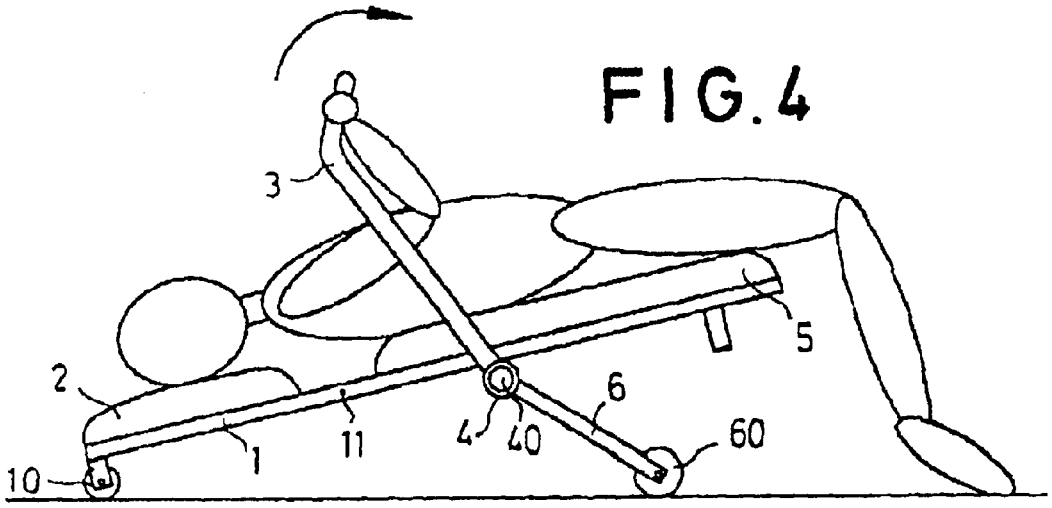
FIG. 4 shows a first application example of the present invention.
Figure 3:
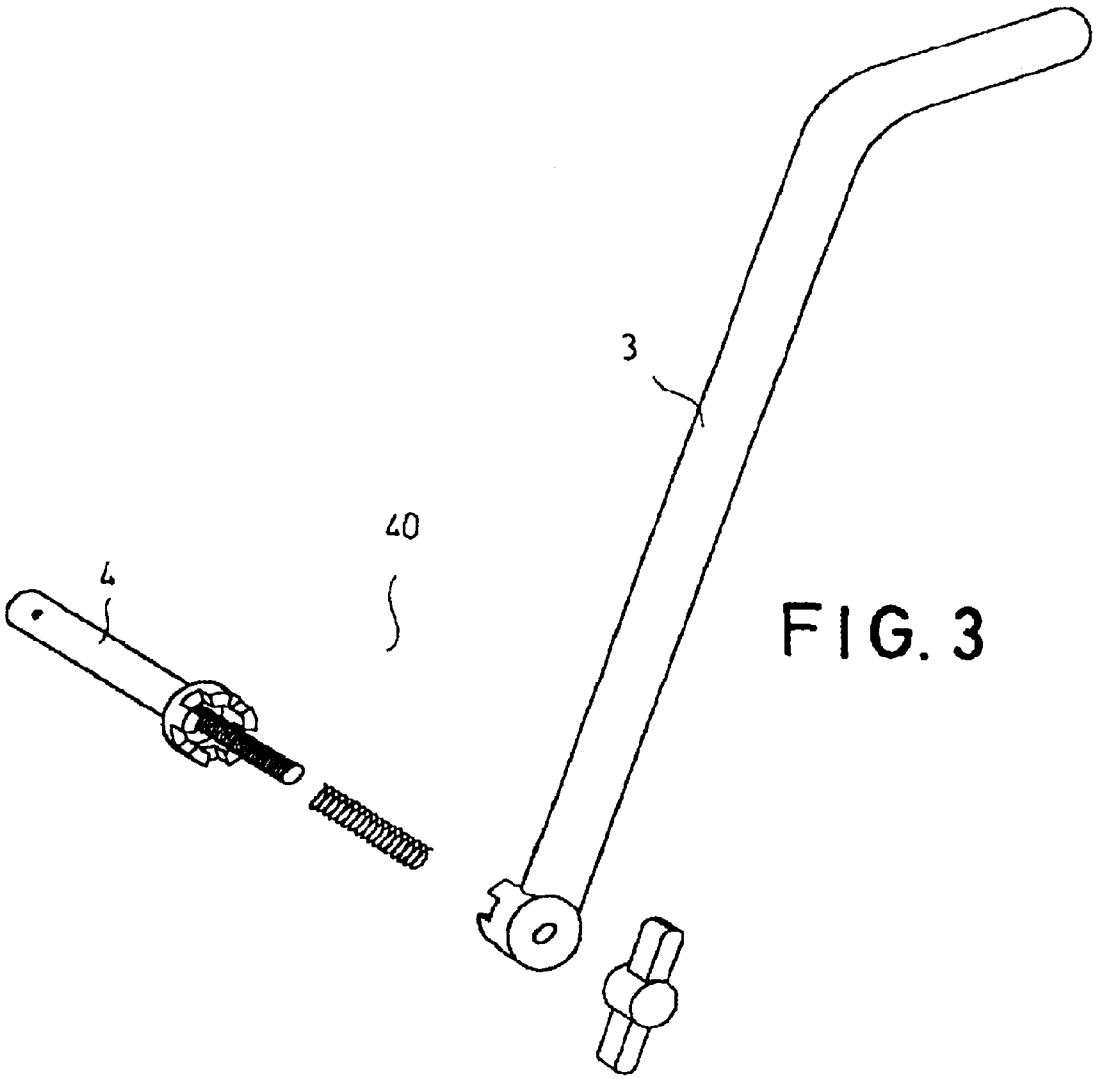
FIG. 3 is an exploded view of a part of the present invention, showing the structure of a ratchet connector.
Figure 5:
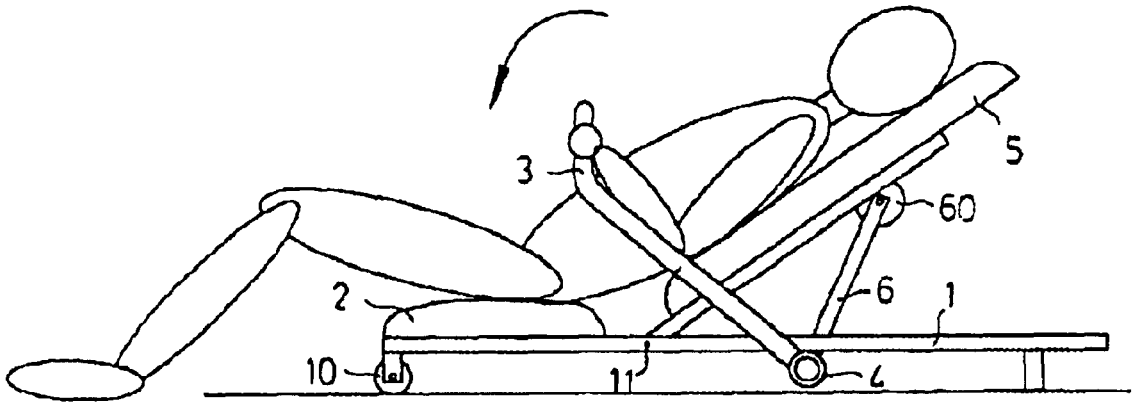
FIG. 5 shows a second application example of the present invention.
Figure 6:
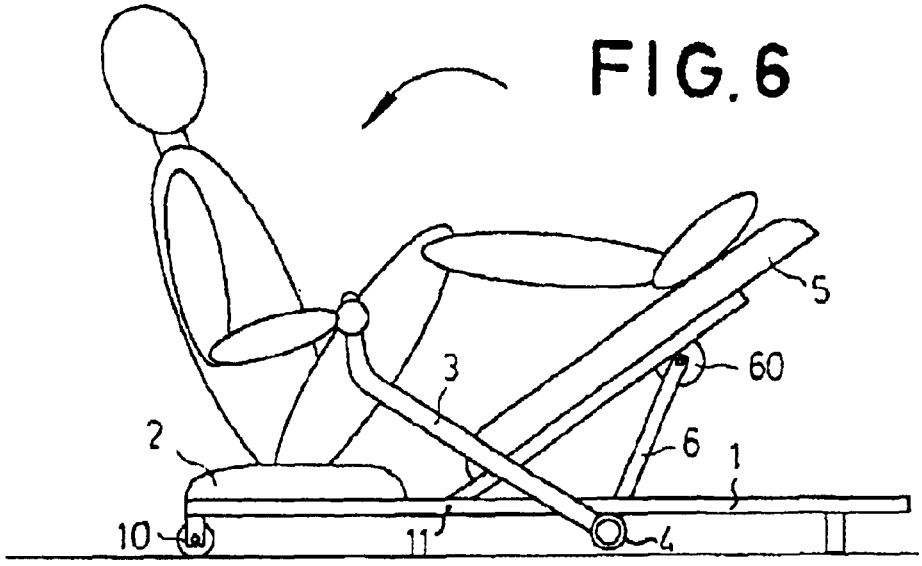
FIG. 6 shows a third application example of the present invention.
Figure 7:
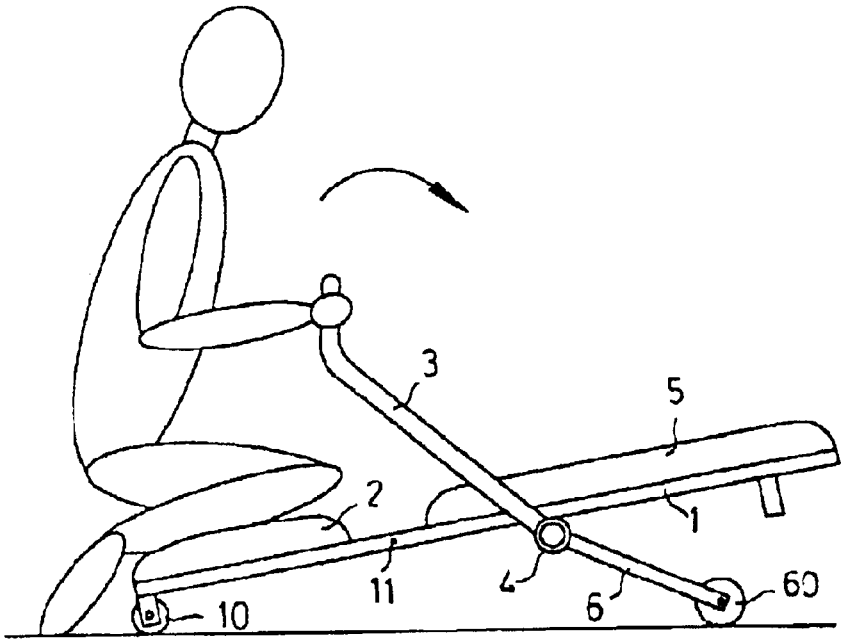
FIG. 7 shows a fourth application example of the present invention.
Figure 8:
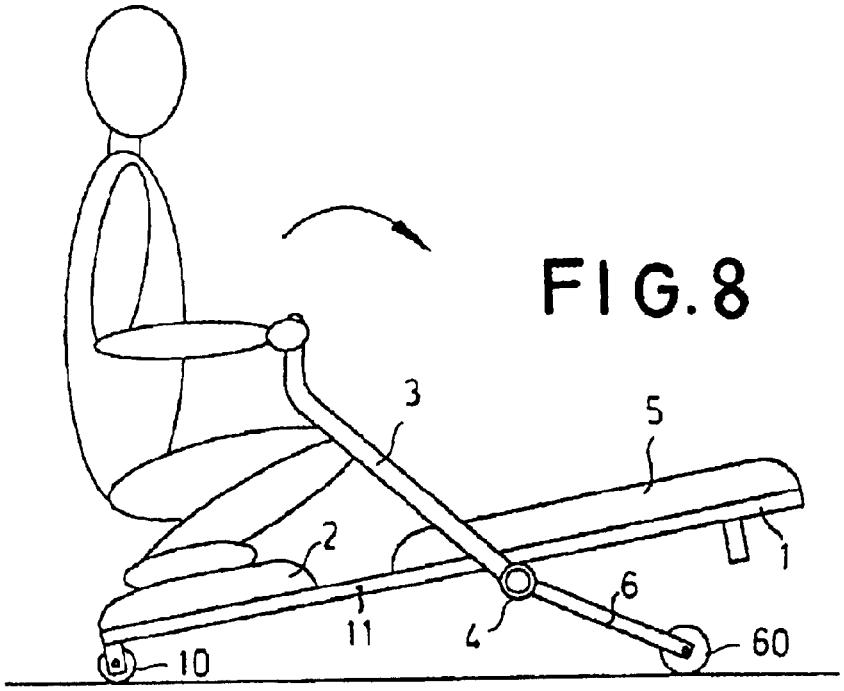
FIG. 8 shows a fifth application example of the present invention.
Figure 9:
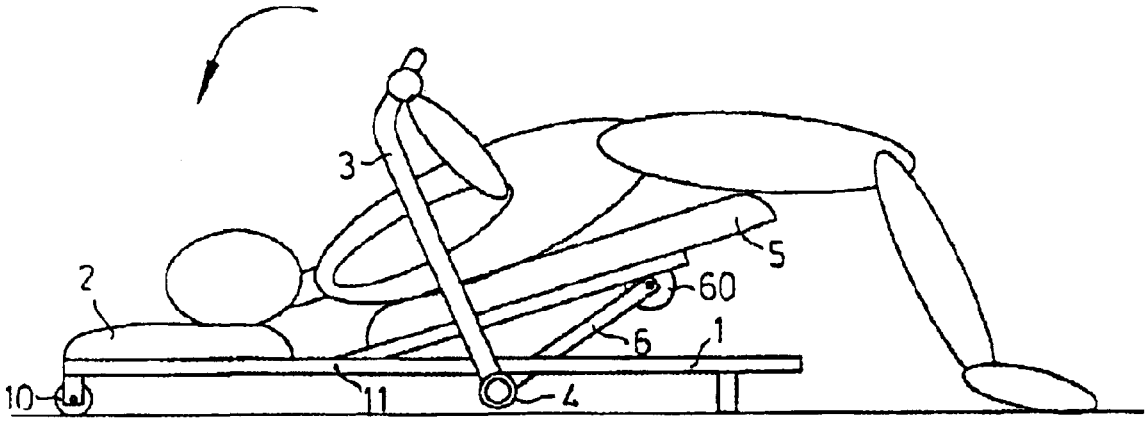
FIG. 9 shows a sixth application example of the present invention.
Figure 10:
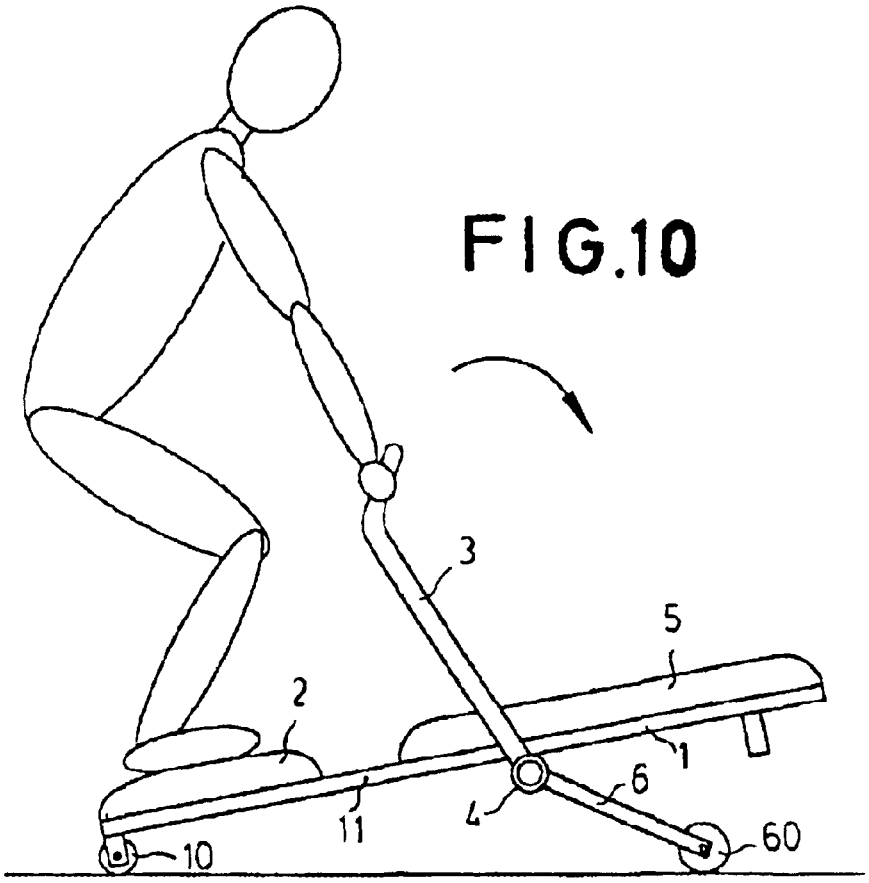
FIG. 10 shows a seventh application example of the present invention.
Figure 11:
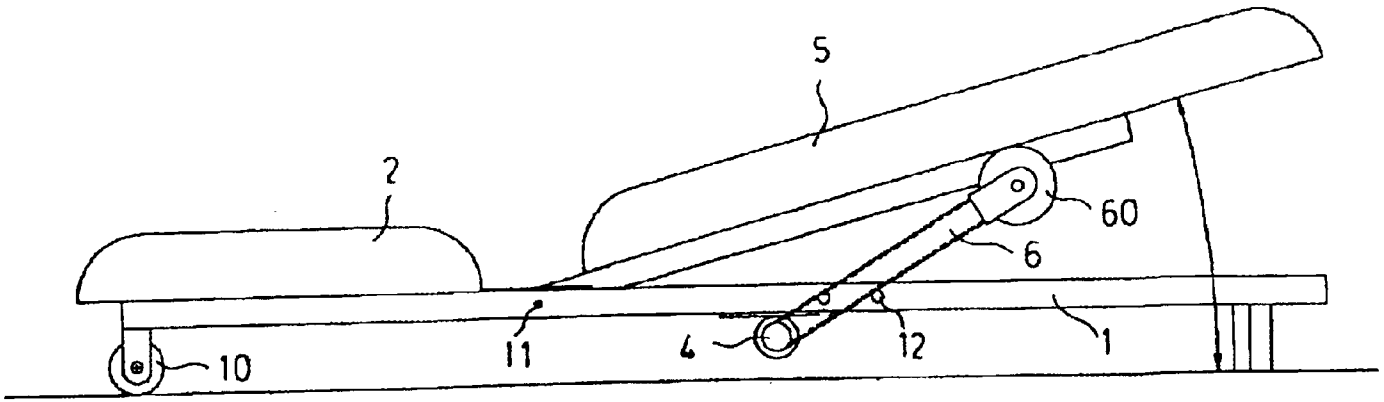
FIG. 11 is a schematic side view of an another base frame of the present invention in one way.
Figure 12:
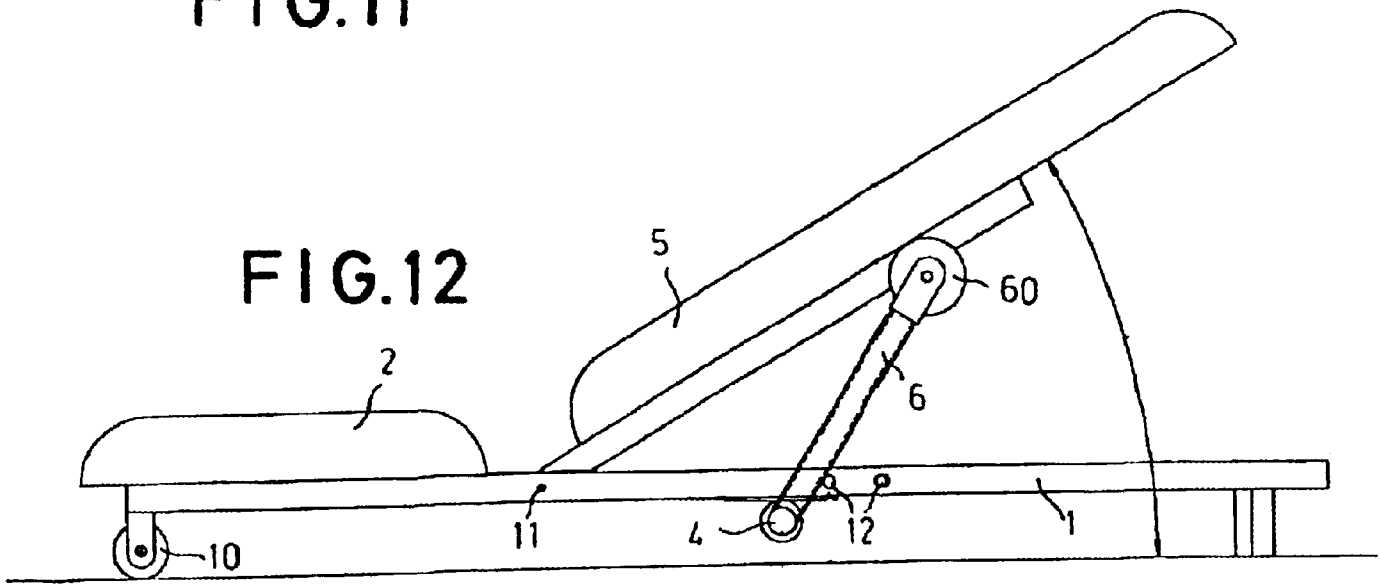
FIG. 12 is a schematic side view of the present invention in FIG. 11 in another way.

Referring to FIGS. from 5 through 10 and FIG. 4 again, the angle-adjustable rowing exerciser can be operated in any of a variety of operation modes. For example, the user can lie on the mattresses 2 and 5, sit, kneel or stand on the first mattress 2, or sit on the heels above the first mattress 2, and turn the handlebars 3 back and forth when keeping the rollers 60 of the actuating bars 6 stopped at the floor (see FIGS. 4, 7, 8 and 10) or the bottom of the second mattress 5 (see FIGS. 5, 6 and 9). When turning the handlebars 3 back and forth, the second mattress 5 or the base frame 1 is tilted up and down. By means of adjusting the angular position of the handlebars 3 relative to the transverse frame bar 4, the exercising amount is relatively adjusted. Referring to FIGS. 11 and 12, when insert a bar into the holes 12. Because the actuating bars 6 is confined by the bar. So the second mattress 5 only can incline an angle.

It is to be understood that the drawings are designed for purposes of illustration only, and are not intended for use as a definition of the limits and scope of the invention disclosed.

What the invention claimed is:

1. An angle-adjustable exerciser comprising:

a base frame equipped with one or more rollers for moving on a floor;

a mattress fixedly mounted on at least at one end to said base frame;

a transverse frame bar physically connected to said frame and transversely pivoted to said base frame below said mattress, said transverse frame bar having two distal ends extended out of two opposite lateral sides of said base frame;

one or more handlebars each connected to one of said two distal ends of said transverse frame bar for turning by hand to rotate said transverse frame bar; and one or more actuating bars connected to said transverse frame bar.

2. An angle-adjustable exerciser according to claim 1 wherein said transverse frame bar comprises two adjustable ratchet connectors respectively disposed at the two distal ends thereof and connected to said handlebars to hold said handlebars in one of a series of angular positions relative to said transverse frame bar.

3. An angle-adjustable exerciser according to claim 1 wherein said base frame further comprises one or more set holes along a side of said base frame, and a bar inserted in one of said set holes to confine the inclined angle of said actuating bars.

4. An angle-adjustable exerciser according to claim 1 wherein each of said one or more actuating bars further comprising a distal end mounted with a roller.

5. An angle-adjustable exerciser as set forth in claim 1, wherein each of said one or more actuating bars having a distal end in direct contact with a surface of said base support during use.

6. An angle-adjustable exerciser as set forth in claim 5, wherein each of said one or more actuating bars having a distal end in direct contact with a surface of said mattress during use.

7. An angle-adjustable exerciser as set forth in claim 1, wherein said mattress is used as a cushioned platform on which an operator stands during use.

8. An angle-adjustable exerciser as set forth in claim 1, wherein said mattress is used as a cushioned platform on which an operator kneels during use.

9. An angle-adjustable exerciser as set forth in claim 1, wherein movement of said one or more handlebars by an operator mounted on said mattress lifts said operator's entire body away from said floor.

10. An exercise machine, comprising:

a base frame;

body support portion which can support an operator, said body support portion coupled to said base frame at least at one end thereof;

actuator which pivots with respect to said body support portion during use, said actuator pivotally coupled to said base frame, thereby lifting said body support portion during use.

11. An exercise machine as set forth in claim 10, further comprising at least one grip coupled to said actuator for which can be engaged by the hands of said operator.

12. An exercise machine as set forth in claim 10, wherein said support means supports said operator standing during use.

13. An exercise machine as set forth in claim 10, wherein said body support portion supports said operator kneeling during use.

14. An exercise machine as set forth in claim 10, wherein rotation of said actuator drives said body support portion to lift said operator's entire body mounted thereon away from said floor.

15. A method for exercising comprising the steps of kneeling on a cushioned surface of an exercise machine, said exercise machine comprising a base frame, having one or more rollers for moving on a floor, a mattress fixedly mounted on at least at one end to said base frame, a transverse frame bar transversely pivoted to said base frame below said mattress, said transverse frame bar having two distal ends extended out of two opposite lateral sides of said base frame, one or more handlebars each connected to one of said two distal ends of said transverse frame bar for turning by hand to rotate said transverse frame bar, and one or more actuating bars connected to said transverse frame bar;

bar, and one or more actuating bars connected to said transverse frame 12 bar;

grasping at least one of said handlebars;

pivoting in a first direction said at least one of said handlebars about one of said two distal ends of said transverse frame bar;

reversing said pivoting motion of said at least one of said handlebars; and repeating the foregoing steps in order to obtain a workout.

16. A method of exercising as set forth in claim 15 wherein said pivoting motion and reverse pivoting motion cause lifting motion of an operator kneeling on said cushioned surface.

17. A method for exercising comprising the steps of standing on a cushioned surface of an exercise machine, said exercise machine comprising a base frame, having one or more rollers for moving on a floor, a mattress fixedly mounted on at least at one end to said base frame, a transverse frame bar transversely pivoted to said base frame below said mattress, said transverse frame bar having two distal ends extended out of two opposite lateral sides of said base frame, one or more handlebars each connected to one of said two distal ends of said transverse frame bar for turning by band to rotate said transverse frame bar, and one or more actuating bars connected to said transverse frame bar;

grasping at least one of said handlebars;

pivoting in a first direction said at least one of said handlebars about one of said two distal ends of said transverse frame bar;

reversing said pivoting motion of said at least of one said handlebars; and repeating the foregoing steps in order to obtain a workout.

18. A method of exercising as set forth in claim 17 wherein said pivoting motion and reverse pivoting motion cause lifting motion of an operator standing on said cushioned surface.

* * * * *